US005097989A

United States Patent [19]

Nakayama et al.

[11] Patent Number: 5,097,989

[45] Date of Patent: Mar. 24, 1992

[54] BEVERAGE MIXING AND DISPENSING APPARATUS

[75] Inventors: Shunichi Nakayama, Takasaki; Yasushi Takayanagi, Akabori, both of Japan

[73] Assignee: Sanden Corporation, Japan

[21] Appl. No.: 443,186

[22] Filed: Nov. 30, 1989

Related U.S. Application Data

[63] Continuation-in-part of Ser. No. 332,982, Apr. 4, 1989.

[30] Foreign Application Priority Data

Nov. 30, 1988 [JP] Japan ..... 63-154830[U]

[51] Int. Cl.[5] ..... B67D 5/56

[52] U.S. Cl. ..... 222/82; 222/91; 222/129.1; 222/145; 222/394; 222/506; 222/400.7

[58] Field of Search ..... 222/81, 82, 83.5, 88–91, 222/481, 483, 484, 488, 129.1, 129.2, 129.3, 129.4, 145, 399, 464, 400.7, 400.8, 185

[56] References Cited

U.S. PATENT DOCUMENTS

| | | | |
|---|---|---|---|
| 2,462,019 | 2/1949 | Bowman . | |
| 2,712,887 | 7/1955 | King . | |
| 3,200,994 | 8/1965 | Levinson . | |
| 3,231,140 | 1/1966 | Krup | 222/129.2 |
| 3,240,395 | 3/1966 | Carver | 222/129.1 |
| 3,348,737 | 10/1967 | Yingst et al. . | |
| 3,638,392 | 1/1972 | Welker, Jr. et al. . | |
| 4,493,441 | 1/1985 | Sedam et al. . | |
| 4,555,371 | 11/1985 | Jeans . | |
| 4,582,223 | 4/1986 | Kobe . | |
| 4,592,490 | 6/1986 | McMichael | 222/129.1 |
| 4,649,809 | 3/1987 | Kanezashi . | |
| 4,688,701 | 8/1987 | Sedam . | |
| 4,836,414 | 6/1989 | Credle, Jr. et al. . | |
| 4,932,561 | 6/1990 | Boxall | 222/129.1 X |
| 4,993,601 | 2/1991 | Nakayama et al. | 222/129.1 X |
| 5,033,648 | 7/1991 | Nakayama et al. | 222/129.1 |

FOREIGN PATENT DOCUMENTS

| | | |
|---|---|---|
| 0102527 | 3/1984 | European Pat. Off. . |
| 0302262 | 6/1989 | European Pat. Off. . |

*Primary Examiner*—Kevin P. Shaver

*Attorney, Agent, or Firm*—Banner, Birch, McKie & Beckett

[57] ABSTRACT

A beverage dispensing unit for dispensing syrup from a syrup container and mixing the syrup with diluted water and carbonated water is disclosed. The unit includes a body having a syrup flow path, a gas supply path, and a receiving portion for the syrup container. The interior of the syrup container is linked to the gas supply path which supplies carbon dioxide into the interior of the syrup container so as to drive the syrup out of the syrup container and into the syrup flow path. The syrup container is disposed in the receiving portion which includes a first and second hole such that the first hole is linked to the gas supply path and the second hole is linked to the syrup path. A projecting portion is integrally formed with the receiving portion and includes a separating wall which separates the first and second holes so as to prevent the carbon dioxide from flowing directly from the first hole to the second hole. Therefore, a constant rate of syrup is dispensed from the syrup container, independently of the volume of syrup remaining within the syrup container.

10 Claims, 9 Drawing Sheets

BEVERAGE MIXING AND DISPENSING APPARATUS

This application is a Continuation-In-Part of Ser. No., 332,982, filed on Apr. 4, 1989.

BACKGROUND OF THE INVENTION

1. Field of the Invention

This invention relates to a dispensing unit for dispensing beverages mixed from a syrup, and more particularly, to providing for a constant flow of the syrup from a syrup storage container independently of the volume of syrup remaining in the container.

2. Description of the Prior Art

Various types of beverage mixing and dispensing units are known in the prior art. For example, post-mix beverage dispensing units are disclosed in U.S. Pat. Nos. 4,493,441 and 4,688,701 to Sedam et al. and Sedam, respectively. The dispensing unit dispenses a plurality of types of syrups, each type of syrup stored in a bottle or syrup package, and includes a main body, a controlling unit and a receiving unit. The syrup package includes an outlet portion having an opening at the bottom thereof from which the syrup is discharged. The body includes a syrup path through which the syrup flows from the bottle. The receiving unit receives the outlet portion of the syrup bottle thereon and the syrup path communicates with the syrup bottle through the opening of the outlet portion. The syrup is discharged from the syrup bottle through the opening of the outlet portion to the syrup path. The controlling unit is coupled to the syrup path to control the flow of syrup from the syrup bottle to the syrup path, and for controlling the mixing of the syrup with carbonated water and dispensation of the mixed beverage from the unit.

Since the above discussed beverage unit is compact, it may advantageously be placed in a limited space. However, the flow rate of the syrup from the bottle to the syrup path varies in dependence on the amount of the syrup remaining in the syrup bottle due to the fact that the discharge of syrup from the syrup bottle occurs only due to the effect of gravity. Since it is difficult to ensure a constant dispensing rate of the syrup from the syrup bottle each time the controlling unit is operated to dispense the mixed beverage, it is difficult to ensure that a uniformly mixed beverage with a uniform volume will be dispensed.

SUMMARY OF THE INVENTION

The present invention is directed to dispensing unit for dispensing a beverage mixed from a syrup contained in a syrup container. The unit includes a body having a syrup path and a receiving member for receiving the syrup container therein so that the syrup container is coupled with the syrup path. A gas supply path is coupled to the receiving means and supplies pressurized gas to the container such that the gas acts to urge the syrup from the container and into the syrup path. A separating wall projects into the container and prevents the flow of gas directly from the gas supply path and into the syrup path without forcing the syrup to flow into the syrup path.

In a preferred embodiment, the receiving member includes first and second holes such that the first hole links the container to the syrup path and the second hole links the container to the gas supply path. The separating wall projects from the receiving member and separates the first and second holes, to prevent the gas from flowing directly from the second hole to the first hole.

The present invention provides the advantage that the rate of delivery of syrup from the syrup bottle to the syrup path is substantially constant, thereby allowing the unit to dispense a uniform volume of a uniformly mixed beverage.

DETAILED DESCRIPTION OF PREFERRED EMBODIMENTS

Figure 1:
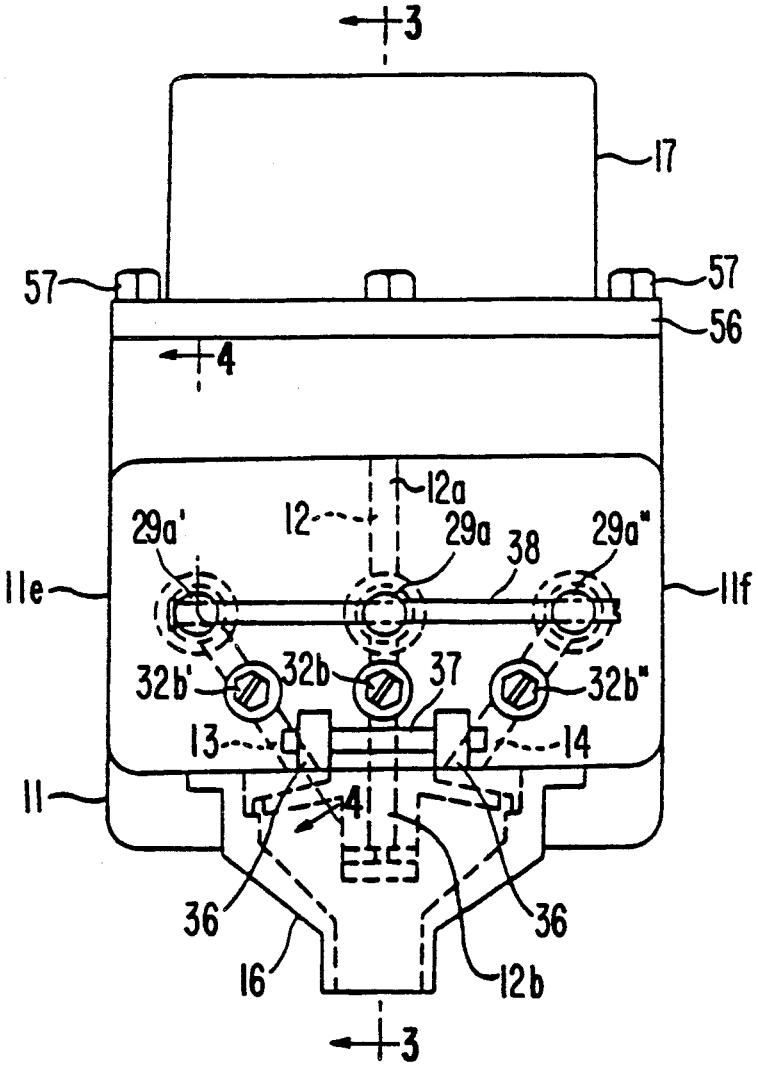
FIG. 1 is a front view of a dispensing unit according to the present invention.

Referring to FIGS. 1–4, a dispensing unit according to the present invention is shown. Dispensing unit 1 includes body 11 having front surface 11*a*, rear surface 11*b*, upper surface 11*c*, bottom surface 11*d*, left side surface 11*e*, and right side surface 11*f*. Body 11 includes syrup path 12 having upper section 12*a* and lower section 12*b* linked by cylindrical bore hole 23, dilution water path 13, and carbonated water path 14. Body 11 is fixed to frame 15 by a plurality of screws or other suitable fastening elements.

Syrup path 12 extends substantially in the vertical direction along a central portion of body 11. Upper section 12*a* has an inlet at upper surface 11*b* and lower section 12*b* has an outlet opening at bottom surface 11*d*. Dilution water path 13 and carbonated water path 14 are disposed along the left and right sides of syrup path 12, respectively, and extend inwardly towards syrup path 12. Each of dilution and carbonated water paths 13 and 14 includes an inlet which opens at rear surface 11*b* and an outlet which opens at bottom surface 11*d*, at a location near the outlet of syrup path 12. The outlets of each of paths 12, 13 and 14 open within discharge tube 16 which is attached to bottom surface 11*d* of body 11.

Receiving member 17 is detachably mounted on upper surface 11*c* of body 11, and detachably receives syrup bottles S therein. Syrup for mixing with the dilution water and the carbonated water within discharge tube 16 is stored in syrup bottles S, and when the supply of syrup within a syrup bottle S is depleted, bottle S is removed and a fresh syrup bottle is inserted in its place. Receiving member 17 may also be changed in dependence upon the size of syrup bottle S used therewith.

Carbonated gas path 18 extends within body 11 from rear surface 11*b* to a location adjacent receiving member 17 as is shown in FIG. 3. Gas path 18 is connected to a $CO_2$ gas cylinder (not shown) through pipe 19 such that pressurized $CO_2$ gas is supplied from the $CO_2$ gas cylinder into syrup bottle S through hole or passageway 62 formed in receiving member 17, as further discussed below. Check valve 20 is disposed in gas path 18 to prevent the flow of syrup from syrup bottle S into gas path 18. The pressurized $CO_2$ gas which flows into syrup bottle 17 forces the syrup to flow therefrom and into syrup path 12 through the inlet of upper section 12*a*. As a result, syrup flows through syrup path 12 towards discharge tube 16.

Figure 4:
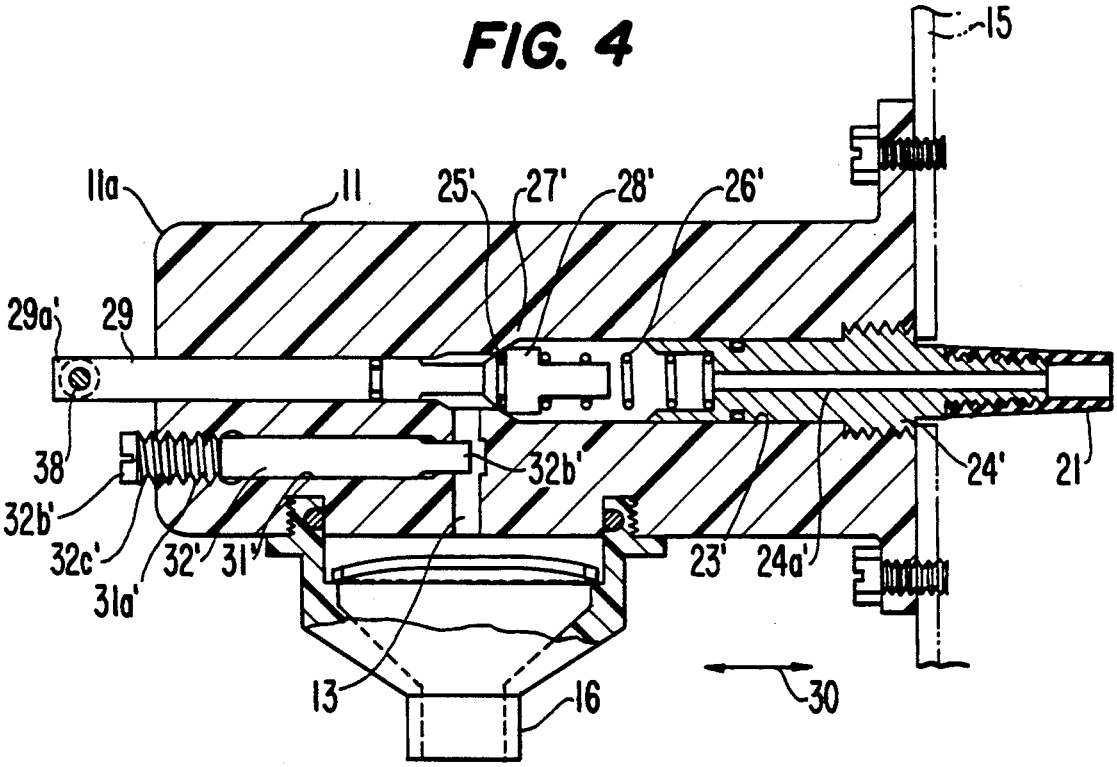
FIG. 4 is a sectional view taken along line 4—4 in FIG. 1.

Dilution water path 13 is linked at the inlet opening by cylindrical bore hole 23' and pipe 21 to a dilution water source (not shown). Path 13 conducts dilution water from the water source (not shown) towards discharge tube 16 as shown in FIGS. 2 and 4. Similarly, carbonated water path 14 is linked at the inlet opening thereof by cylindrical bore hole 23'' and pipe 22 to a source of carbonated water (not shown). Carbonated water path 14 conducts carbonated water from the source towards discharge tube 16.

With respect to FIG. 3, body 11 includes cylindrical bore hole 23 extending therethrough. Closing member 24 is screwed into cylindrical bore hole 23 from rear surface 11*b* and closes cylindrical bore hole 23 at the rear end. Syrup path 12 includes upper section 12*a* and lower section 12*b* which are linked by cylindrical bore hole 23. Valve 25 is disposed within cylindrical bore hole 23 between the upper and lower sections of syrup path 12, and thereby controls the opening and closing of syrup path 12 to control the flow of syrup from syrup bottle S to discharge tube 16. Valve 25 is urged forwardly by spring 26 which is disposed between valve 25 and closing member 24. Adjacent the location of upper syrup path 12*b*, cylindrical bore hole 23 narrows at the location of valve seat 27. Valve 25 is urged by spring 26 into contact with valve seat 27 so as to terminate the link between upper and lower syrup path sections 12*a* and 12*b*, thereby closing syrup path 12. Seal member 28 is mounted on valve 25 in order to ensure complete closure of syrup path 12 when valve 25 is adjacent valve seat 27.

Valve rod 29 is disposed in the front portion of cylindrical bore hole 23 so as to extend from front surface 11*a* of body 11, and is fixedly connected to valve 25. Both valve rod 29 and valve 25 are movable in the horizontal direction denoted by double arrow ended line segment 30. Forward end 29*a* of valve rod 29 projects forwardly from front surface 11*a*. When valve rod 29 is pushed in the rearward direction, valve 25 is displaced against the force of spring 26, moving valve 25 away from valve seat 27 to link upper and lower syrup path sections 12*a* and 12*b* and thereby allow the flow of syrup through syrup path 12.

Body 11 further includes adjusting hole 31 which extends from front surface 11*a* to a location in lower syrup path section 12*a* of syrup path 12, just below cylindrical bore hole 23. Hole 31 extends into lower syrup path section 12*b*. Adjusting hole 31 includes internal threaded portion 31*a*. Adjusting member 32 includes external threaded portion 32*c* at its forward end and head portion 32*b* projecting from adjusting hole 31. Member 32 is disposed in hole 31 and threaded portion 32*c* is screwed into internal threaded portion 31*a*. Rear end portion 32*a* of adjusting member 32 variably extends within lower syrup path section 12*b*. The volume flow rate of the syrup through syrup path 12 may be adjusted by rotation of adjusting member 32, displacing it in the horizontal direction 30, and thereby adjusting the degree to which end 32*a* is disposed within syrup path 12. Adjusting member 32 may be rotated by the use of any driving member such as a screw driver (not shown).

With reference to FIG. 4, dilution water path 13 is shown. Dilution water path 13 has many associated elements which are identical with the elements associated with syrup path 12, and which are designated with the identical primed reference numeral. Dilution water path 13 is linked to cylindrical bore hole 23'. Closing member 24' is inserted through rear surface 12*b* and includes hole 24*a'* disposed therethrough. Through hole 24*a'* is linked to a source of dilution water by inlet pipe 21 such that dilution water flows through cylindrical bore hole 23', and into dilution water path 13 via valve seat 27'. The opening and closing of valve seat 27' is controlled by valve 25' disposed on valve rod 29'. Spring 26' is disposed between valve 25' and closing member 24' so as to urge valve 25' into a position closing valve seat 27'. As with syrup path 12, when valve rod 29' is moved rearwardly, valve 25' is displaced against the force of spring 26' so as to allow dilution water to flow through valve seat 27', and into discharge tube 16 via dilution water path 13. Adjusting member 32' may be rotated within hole 31' so as to control the flow of dilution water through dilution water path 13.

Carbonated water path 14 has an identical structure as dilution water path 13 as shown in FIG. 4. Additionally, the control of the carbonated water flow from inlet pipe 22 through path 14 is identical with the flow of dilution water through path 13. Therefore, further description of the carbonated water path is omitted.

Figure 5:
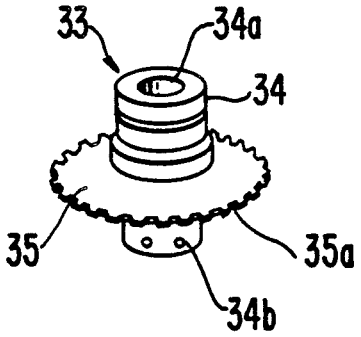
FIG. 5 is a perspective view of the mixing member shown in the dispensing unit of FIGS. 1–4.

When it is desired to mix a beverage, syrup from path 12, dilution water from dilution water path 13, and carbonated water from carbonated water path 14 are mixed in the interior of discharge tube 16 to form the finished beverage. In order to enhance the mixing of the syrup, dilution water and carbonated water, mixing member 33 is disposed in discharge tube 16. With reference to FIG. 5, mixing member 33 include cylindrical member 34 having ring shaped plate 35 fixed onto an outer peripheral surface thereof. Cylindrical member 34 also includes central hole 34*a* extending therethrough from a top opening to a location near the bottom. Central hole 34*a* is linked with a plurality of small radially formed holes 34*b* extending through the outer peripheral surface of cylindrical member 34. Cylindrical member 34 is disposed in a corresponding receiving hole in lower surface 11*d* of body 11 such that central hole 34*a* is linked directly with syrup path 12 such that syrup flows from path 12, through central hole 34*a* and out of holes 34*b* within discharge tube 16.

Ring shaped plate 35 includes a plurality of grooves 35*a* formed in a peripheral surface thereof, and is supported on shoulder 16*a* formed on the inner peripheral surface of discharge tube 16. Ring shaped plate 35 is disposed under the outlet openings of both dilution water path 13, and carbonated water path 14. Additionally, peripheral surfaces 35*a* of ring shape plate 35 are disposed adjacent inner peripheral surface 16*b* of discharge tube 16, thereby creating a plurality of small guiding holes through which dilution and carbonated water may flow to a location below ring shaped plate 35. Therefore, when paths 12, 13 and 14 are opened, syrup flows out of holes 34*b* and is mixed with carbonated water and dilution water flowing through the plurality of small guiding holes, such that the three ingredients are mixed within discharge tube 16 and dispensed from a lower outlet thereof into a waiting receptacle such as a cup.

Figure 6:
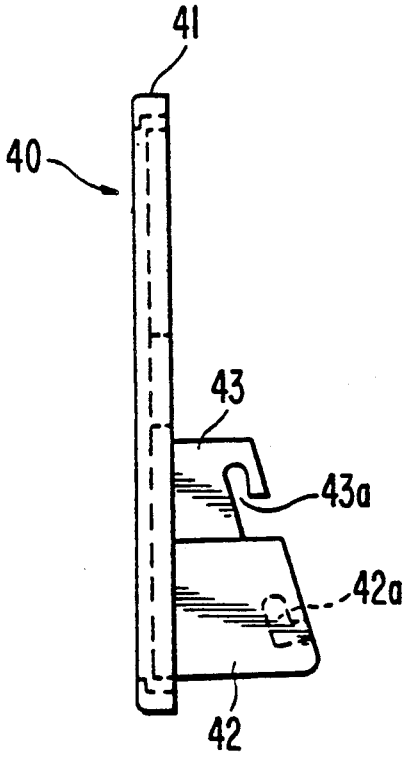
FIG. 6 is a side view of an operating member included in the dispensing unit as shown in FIG. 3.
Figure 7:
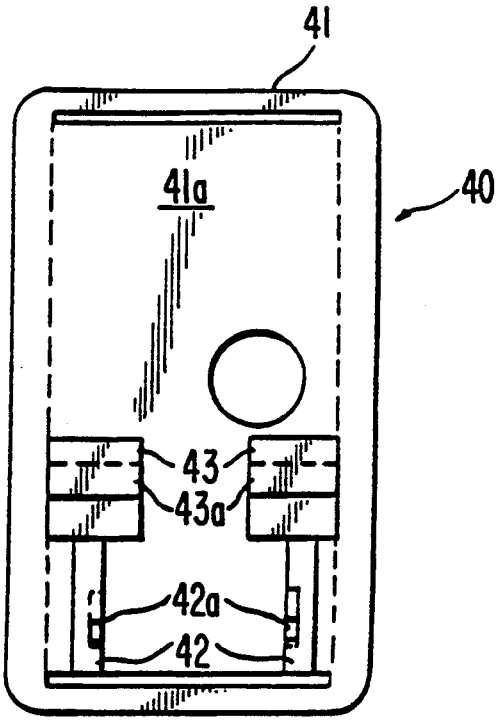
FIG. 7 is a rear view of the operating member shown in FIG. 6.

With further reference to FIGS. 1–4, body 11 further includes two integrally formed forwardly projecting arms 36 having shaft 37 pivotably disposed therethrough. The pivot axis of shaft 37 is substantially perpendicular to horizontal direction 30. Forward ends 29*a*, 29*a*', and 29*a*" of valve rods 29, 29' and 29" which are disposed in corresponding cylindrical bore holes 23, 23' and 23" are linked through horizontally disposed pin rod 38 at a location forward of front surface 11*a* of body 11. With further reference to FIG. 6 and 7, operating member 40 which may be operated by the user is shown. Operating member 40 includes plate portion 41, two rearwardly projecting attaching portions 42 and two hooking portions 43. Plate portion 41 includes back surface portion 41*a* which is placed so as to face the front surface 11*a* of body 11 covering end portions 32*b*, 32*b*' and 32*b*" of adjusting members 32, 32' and 32". Each of attaching portions 42 is formed integrally with back surface 41*a* of plate portion 41, and includes attaching groove 42*a* which receives both ends of shaft 37 therein. Attaching grooves 42*a* are extended to permit movement of operating member 40 in both horizontal direction 30, and in a generally perpendicular, upward direction. Each of hooking portions 43 is formed integrally with back surface 41*a* of plate portion 41, and includes hooking groove 43*a* for receiving pin rod 38 therein so as to hook plate portion 41 about pin rod 38. Hooking grooves 43*a* are extending so that hooking portion 41 may be easily removed from pin rod 38 by simply moving operating member 40 upwardly.

When plate portion 41 is pushed rearwardly by an operator, operating member 40 is pivotably moved about shaft 37. Valve rod 29, 29' and 29" are moved rearwardly so as to open syrup, dilution water, and carbonated water paths 12, 13 and 14. As a result, the syrup, dilution water and carbonated water are discharged and mixed within discharge tube 16 to produce the mixed beverage. The mixed beverage is discharged in discharge tube 16 into the receptacle cup.

IF it is desired to adjust the flow rate of the syrup, carbonated water and dilution water, hooking portions 43 are removed from pin rod 38 by simply pulling operating member 40 upwardly. The upper part of plate portion 41 is then pulled forwardly so that operating member 40 is pivoted downwardly about shaft 37. Therefore, end portions 32*b*, 32*b*' and 32*b*" of adjusting members 32, 32' and 32" are no longer covered by plate portion 41. The positions of the adjusting members can therefore be easily adjusted to adjust the flow rate of the syrup, carbonated water and dilution water.

Figure 8:
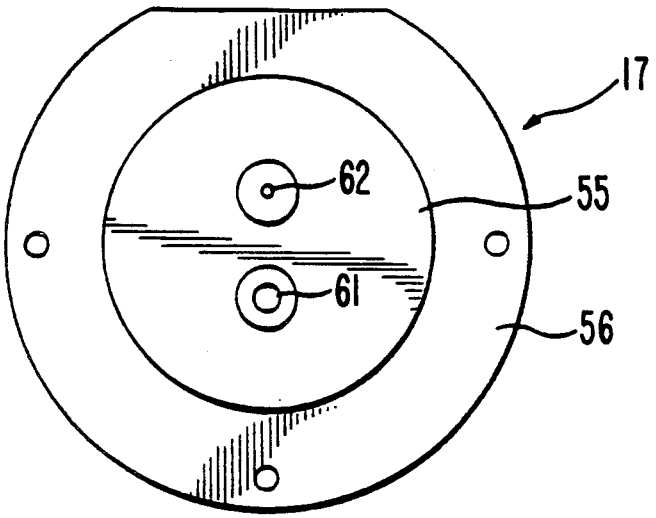
FIG. 8 is a bottom view of a receiving member shown in the dispensing unit of FIGS. 1–4.

With reference to FIG. 8, as well as FIGS. 2 and 3, syrup bottle S includes outlet portion 51 from which syrup is discharged. Outlet portion 51 includes open end 51*a* which is closed by a bottle closing member (not shown) before bottle S is disposed in receiving member 17. Outlet portion 51 also includes threaded portion 52 as well as protrusion 53 formed on the outer peripheral surface thereof. Protrusion 53 protrudes outwardly a greater distance from outlet portion 51 than threaded portion 52. Receiving member 17 further includes cylindrical portion 54 and bottom portion 55 formed integrally with the lower end of cylindrical portion 54. Bottom portion 55 includes first and second through holes or passages 61 and 62 which are linked with syrup and gas paths 12 and 18, respectively. First through hole 61 allows syrup to flow from syrup bottle S into syrup path 12. Second through hole 62 allows $CO_2$ gas from gas path path 18 to flow into syrup bottle S. Flange portion 56 is integrally formed with cylindrical portion 54 at an outer peripheral surface thereof. Flange portion 56 is fixed to upper surface 11*c* of body 11 by a plurality of fixing screws 57. Therefore, it is possible to easily change receiving member 17 by simply removing screws 57.

Cylindrical portion 54 further includes threaded portion 58 on the inner peripheral surface thereof. Threaded portion 58 mates with threaded portion 52 of outlet portion 51 of syrup bottle S so as to allow syrup bottle S to be screwed into and securely held within cylindrical portion 54. Cylindrical portion 54 further include sealing member 59 which is fixed on the inner peripheral surface as described below. Sealing member 59 seals the area between cylindrical portion 54, and outlet portion 51.

Figure 2A:
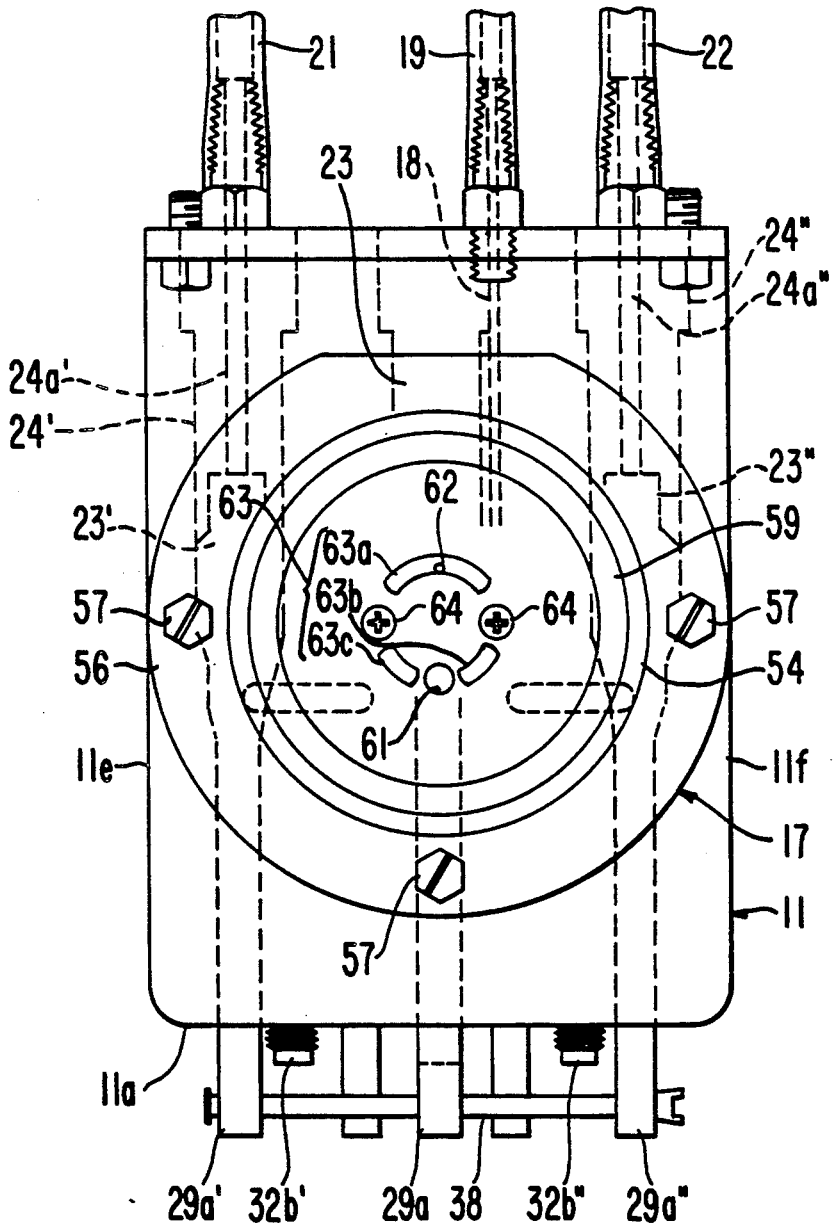
FIG. 2*a* is an overhead view of the dispensing unit illustrated in FIG. 1 including a projecting and cutting element according to a first embodiment.
Figure 3A:
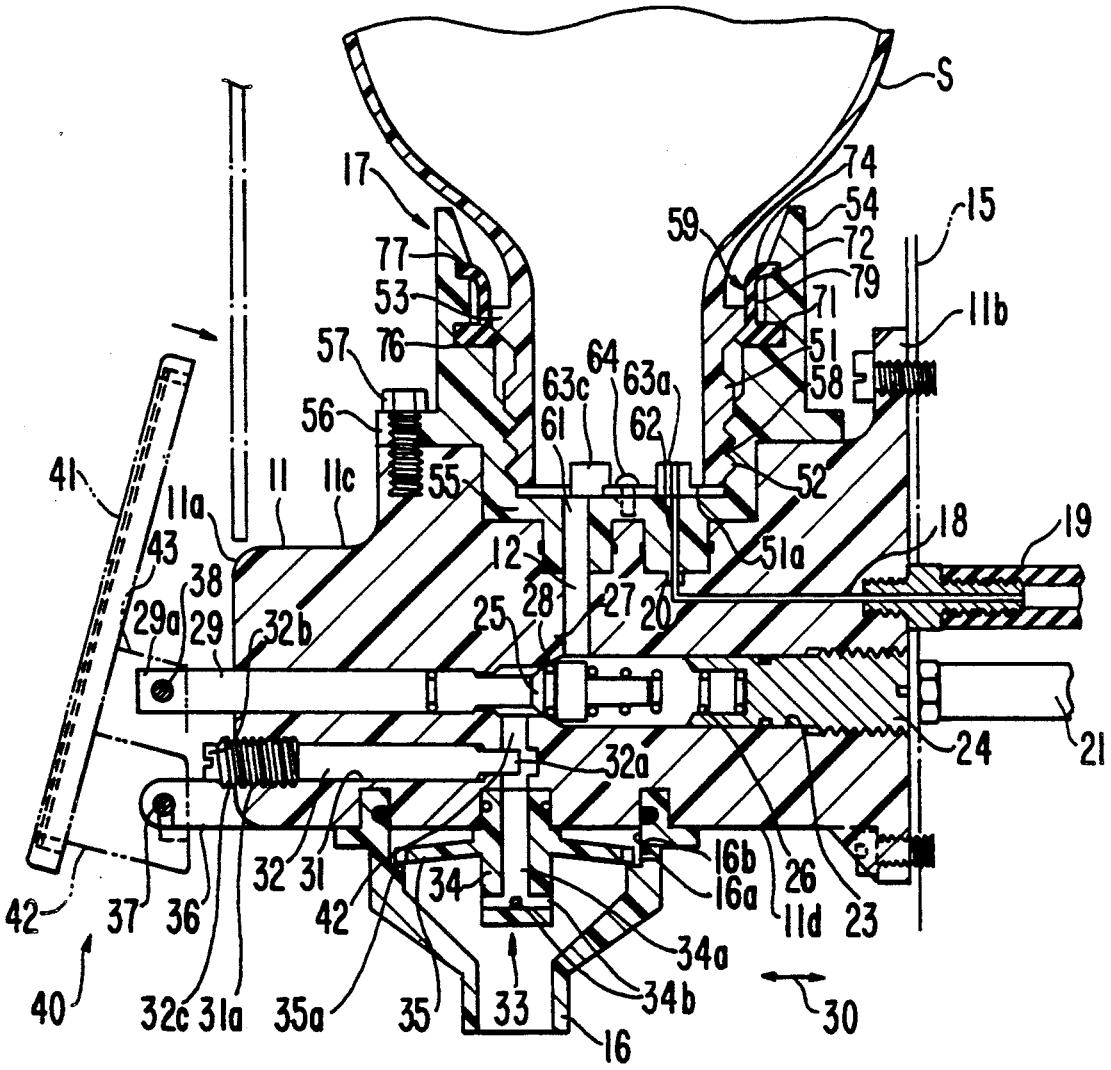
FIG. 3*a* is a sectional view taken along line 3—3 in FIG. 1 and including a projecting and cutting element according to a first embodiment.

With respect to FIGS. 2*a* and 3*a*, projecting and cutting element 63 includes a plurality of circularly arranged arc-like projecting elements 63*a*, 63*b* and 63*c*. Cutting element 63 is fixed to bottom portion 55 by fixing screws 64. Cutting element 63 does not cover either hole 61 or hole 62. When threaded portion 52 of outlet portion 51 is screwed into mating threaded portion 58 of cylindrical portion 54, projecting and cutting element 63 cuts a circular hole in the closing member of outlet portion 51. Therefore, the interior of syrup bottle S is linked to both first and second through holes 61 and 62. As a result, pressurized $CO_2$ gas flows into syrup bottle S through gas path 18 and second hole 62 to drive syrup out of bottle S and into syrup path 12 when rod 29 is pushed rearwardly so as to move valve 25 away from valve seat 27. Thus, it is possible to dispense a substantially constant quantity of syrup from bottle S independently of the quantity of syrup remaining in the bottle.

Figure 2B:
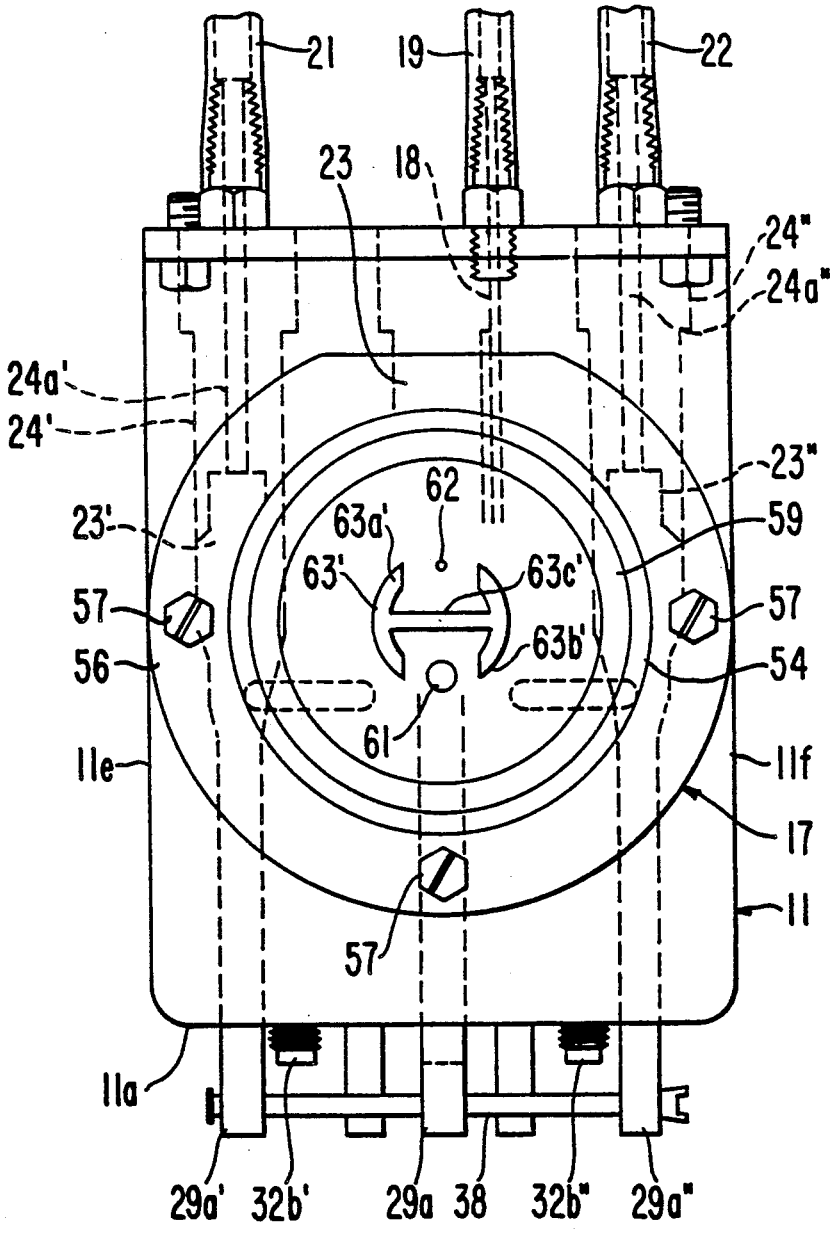
FIG. 2*b* is an overhead view of the dispensing unit shown in FIG. 1 including a projecting and cutting element according to a second embodiment of the invention.
Figure 3B:
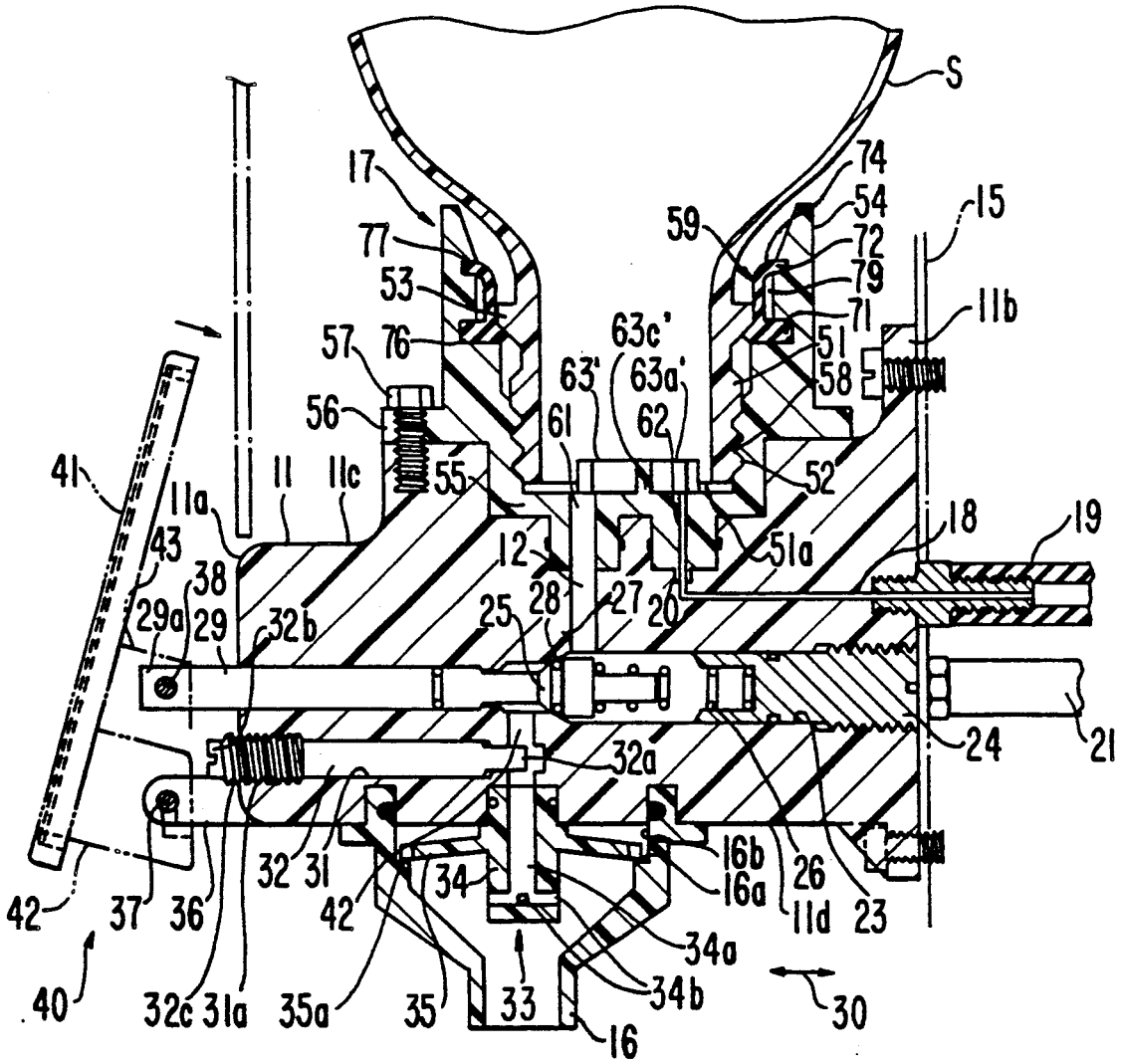
FIG. 3*b* is a sectional view taken along line 3—3 in FIG. 1 and including a projecting and cutting element according to a second embodiment of the invention.

With further reference to FIGS. 2*b* and 3*b*, second embodiment of projecting and cutting element 63' is shown. Projecting and cutting element 63' is integrally formed with bottom portion 55 of receiving member 17 and includes a plurality of projecting elements 63*a*', 63*b*' and 63*c*'. Elements 63*a*' and 63*b*' are arc shaped, and projecting element 63*c*' extends between elements 63*a*' and 63*b*' and serves as a separating wall to separate first through hole 61 from second through hole 62. Projecting and cutting element 63' is integrally formed on the upper surface of bottom portion 55 so as to not cover through holes 61 and 62.

As with projecting and cutting element 63, when threaded portion 52 of outlet portion 51 is screwed into mating threaded portion 58 of cylindrical portion 54 by rotation of syrup bottle S, projecting and cutting element 63' cuts a generally circular hole through the closing member of outlet portion 51, thereby allowing communication between the interior of bottle S, and paths 12 and 18 through holes 61 and 62. As a result, the pressurized $CO_2$ gas flows into syrup bottle S through gas path 18 and second through hole 62 to drive syrup out of bottle S and into syrup path 12 when rod 29 is pushed. Additionally, projecting element 63c' of projecting and cutting element 63' prevents the $CO_2$ gas from flowing directly out of syrup bottle S through first through hole 61 after entering bottle S through hole 62. That is, projecting element 63c' serves as a separating wall which forces the $CO_2$ gas to flow into syrup bottle S for a significant distance before flowing out of hole 61. The $CO_2$ gas drives the syrup from syrup bottle S through first through hole 61 and into syrup path 12, making it possible to dispense a constant quantity of the syrup when operating member 40 is pushed, regardless of the quantity of syrup remaining in the syrup bottle S.

Figure 9:
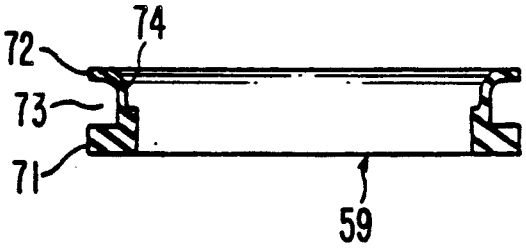
FIG. 9 is a sectional view of a first embodiment of a sealing member included in the dispensing unit shown in FIGS. 1–4.

With reference to FIGS. 3 and 9, sealing member 59 is ring shaped, and is formed of an elastic material such as rubber. Sealing member 59 includes first and second annular flange parts 71 and 72 which define annular outward groove 73 therebetween. Curved part 74 is formed adjacent to second flange part 72 and faces the interior of sealing member 59. Cylindrical portion 54 of receiving member 17 includes first and second grooves 76 and 77 formed on the inner peripheral surface thereof. Sealing member 59 is attached to cylindrical portion 54 such that first and second flange parts 71 and 72 are snugly fit in first and second grooves 76 and 77 respectively.Preferably, sealing member 59 has an inner diameter which is greater than the outer diameter of threaded portion 52 and which is less than the diameter of protrusion 53.

After sealing member 59 is attached to cylindrical portion 54, it is deformed as is shown in FIG. 3. As a result, annular space 79 is left between sealing member 59 and receiving member 17 such that space 79 is within outer groove 73. When outlet portion 51 of syrup bottle S is inserted into receiving member 17, protrusion 53 is pressed into contact with sealing member 59. Therefore, a part of sealing member 59 is pushed by protrusion 53, causing it to deform outwardly. As a result, the sealing between sealing member 59 and protrusion 53 is effectively maintained. Additionally, protrusion 53 may be easily inserted within sealing member 59 due to curve part 74.

Figure 10:
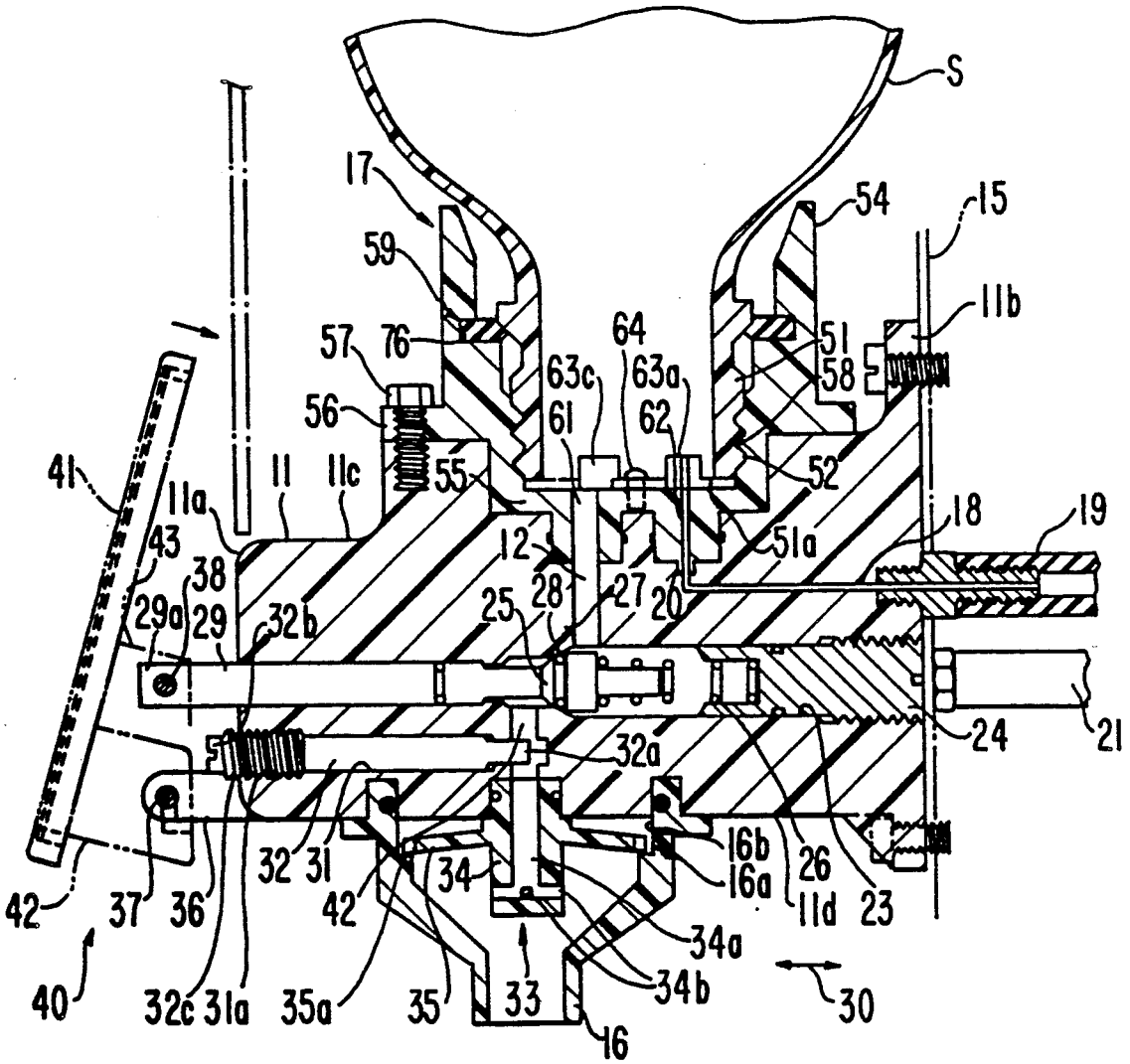
FIG. 10 is a sectional view of a second embodiment of a sealing member included in the dispensing unit shown in FIGS. 1–4.

With reference to FIG. 10, a second embodiment of sealing element is shown. Sealing element 59' has a simple ring shape, making it easier to manufacture.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the appended claims.

We claim:

1. A dispensing unit for dispensing a beverage mixed from a syrup contained in a syrup container having an opening, said dispensing unit comprising:

a body including a syrup path;

receiving means for receiving the syrup container, said receiving means including first and second holes disposed therethrough, said first hole linking the syrup container with said syrup path;

gas supplying means disposed in said body for supplying pressurized gas into the syrup container through said second hole, the gas driving the syrup out of the syrup container and into said syrup path through said first hole;

separating means projecting from said receiving means so as to extend into the syrup container, said separating means separating said first and second holes to prevent the gas from flowing directly from said second hole to said first hole without driving the syrup through said first hole;

control means disposed in said body for controlling the flow of syrup through said syrup path; and at least one supply path through which is dispensed a further fluid to be mixed with said syrup, said control means also for controlling the dispensation of said further fluid through said supply path.

2. The dispensing unit recited in claim 1, said separating means including a separating wall integrally formed with said receiving means and disposed between said first and second holes, said separating means further comprising two arc shaped projecting portions integrally formed with said receiving means and disposed on either end of said separating wall.

3. The dispensing unit recited in claim 2, said separating means projecting into the syrup container so as to cut a circular hole in a bottom closing member disposed at the outlet of the syrup container.

4. The dispensing unit recited in claim 1, said gas supplying means including a gas path which is formed in said body and which terminates beneath said second hole of said receiving means.

5. The dispensing unit recited in claim 4, said gas supplying means further comprising check valve means coupled to said gas path for preventing the flow of syrup from said container to the gas supplying means.

6. A dispensing unit for dispensing a beverage mixed from a syrup contained in a syrup container having an opening, said dispensing unit comprising:

a body including a syrup path;

receiving means for receiving the syrup container, said receiving means including first and second holes disposed therethrough, said first hole linking the syrup container with said syrup path, gas supplying means disposed in said body for supplying pressurized gas into the syrup container through said second hole, the gas driving the syrup out of the syrup container and into said syrup path through said first hole; and separating means projecting from said receiving means so as to extend into the syrup container, said separating means separating said first and second holes to prevent the gas from flowing directly from said second hole to said first hole without driving the syrup through said first hole, said separating means including a separating wall integrally formed with said receiving means and disposed between said first and second holes, said separating means further comprising two arc shaped projecting portions integrally formed with said receiving means and disposed on either end of said separating wall.

7. The dispensing unit recited in claim 6, said separating means projecting into the syrup container so as to cut a circular hole in a bottom closing member disposed at the outlet of the syrup container.

8. The dispensing unit recited in claim 6 further comprising syrup controlling means disposed in said body for controlling the flow of syrup from said syrup container through said syrup path.

9. The dispensing unit recited in claim 6, said gas supplying means including a gas path which is formed in said body and which terminates beneath said second hole of said receiving means.

10. The dispensing unit recited in claim 9, said gas supplying means further comprising a check valve means coupled to said gas path for preventing the flow of syrup from said container to the gas supplying means.

* * * * *